US007946210B1

(12) United States Patent
Schneider et al.

(10) Patent No.: US 7,946,210 B1
(45) Date of Patent: May 24, 2011

(54) VEHICLE PROTECTIVE STRUCTURE

(75) Inventors: John Schneider, Huntingburg, IN (US); Christopher Brown, Bloomington, IN (US); Robin Cromwell, Mitchell, IN (US); Donald Lowe, San Antonio, TX (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 12/547,820

(22) Filed: Aug. 26, 2009

Related U.S. Application Data

(62) Division of application No. 11/998,977, filed on Nov. 10, 2007, now Pat. No. 7,823,498.

(51) Int. Cl.
*F41H 5/20* (2006.01)

(52) U.S. Cl. ..... 89/36.03; 89/36.13

(58) Field of Classification Search ..... 89/36.08, 89/36.13, 36.14, 36.15, 36.07; 109/49.5
See application file for complete search history.

(56) References Cited

U.S. PATENT DOCUMENTS

| | | | | |
|---|---|---|---|---|
| 1,928,306 | A | 9/1933 | Brennan | |
| 2,388,873 | A | 11/1945 | Schwab | |
| 2,436,374 | A | 2/1948 | Birdsall | |
| 3,586,236 | A | 6/1971 | Schaffler | |
| 3,942,598 | A | 3/1976 | Council | |
| 4,358,984 | A | 11/1982 | Winblad | |
| 4,715,263 | A | 12/1987 | Kramer | |
| 4,934,246 | A * | 6/1990 | Benson et al. | 89/36.14 |
| 5,815,302 | A * | 9/1998 | Mc Vey et al. | 359/214.1 |
| 5,942,716 | A | 8/1999 | Miller | |
| 6,302,010 | B1 * | 10/2001 | Holler | 296/187.07 |
| 6,622,607 | B1 | 9/2003 | Miller | |
| 2005/0188831 | A1 | 9/2005 | Squires | |
| 2007/0000377 | A1 | 1/2007 | Ohnstad | |
| 2007/0131103 | A1 | 6/2007 | McClellan | |

OTHER PUBLICATIONS

Armor Holdings.Com, Improved Gunner Protection Kit with Integrated Transparent Armor (I-GPK), http://adg.armorholdings.com/pdfs/Improved%20Gunner%20Protection%20Kit.pdf, viewed Oct. 29, 2007.

Picatinny Arsenal, Picatinny Designs Latest Advancement in Gunner Protection, http://www.pica.army.mil/PicatinnyPublic/warfighter/index.asp, dated Mar. 29, 2007, viewed Oct. 29, 2007.

Patrick A. Serao, U.S. Army Armament Research, Development and Engineering Center (ARDEC) Update, http://www.dtic.mil/ndia/2007armaments/Serao.pdf, Jun. 12, 2007, p. 7, viewed Oct. 29, 2007.

* cited by examiner

*Primary Examiner* — Stephen M Johnson
(74) *Attorney, Agent, or Firm* — Christopher A. Monsey

(57) ABSTRACT

A protective structure for a vehicle having an opening on an upper surface is provided. One embodiment of the invention has at least a partial enclosure around an area defined laterally by the vehicle opening with an overhead and side protective capability. An embodiment of the invention has an overhead cover that is formed to substantially enclose a top area of the enclosure and having multiple panels that may be locked into place or opened by an occupant for exit through a top area of the enclosure. The multiple panels in this embodiment extend upwardly and inwardly from a section of the enclosure's side walls. Ballistic windows are provided on the protective structure such that an occupant can view laterally and vertically through the enclosure and overhead cover. A shield or protective plate can be mounted on one side of the enclosure.

2 Claims, 13 Drawing Sheets

VEHICLE PROTECTIVE STRUCTURE

CROSS-REFERENCE TO RELATED APPLICATION

This application is a divisional of U.S. patent application Ser. No. 11/998,977, filed Nov. 10, 2007, now U.S. Pat. No. 7,823,498 the disclosures of which are expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used, licensed by or for the United States Government for any governmental purpose without payment of any royalties thereon.

FIELD OF THE INVENTION

The invention generally relates to protective structures. In particular, the invention relates to protective structures used for protection against projectiles.

BACKGROUND OF THE INVENTION

The invention relates to protective structures. There is a significant need for the invention as there are no protective structures available or known which provide the features and benefits of the invention.

SUMMARY OF THE INVENTION

The invention relates to protective structures. The invention relates to protective structures adapted to protect against projective weapons or fragments that in one embodiment is mounted to a vehicle to enclose at least part of an area that a weapons or apparatus operator occupies. Embodiments of the invention have an upper section which has protective overhead segments that can be locked and positioned such that an occupant of the protective structure have overhead protection as well as the ability to exit from the protective structure by positioning the segments to permit exit or entry from the top area of the protective structure. The structure has a latching mechanism for at least two of the overhead protective segments which are adapted to withstand an impact from projectiles or fragments from bomb blasts. The protective structure has ballistic window placed around the structure, including the overhead protective segments which permit viewing through the windows and protection against expected projectiles or fragments.

BRIEF DESCRIPTION OF THE DRAWING

In the drawings, which are not necessarily to scale, like or corresponding parts are denoted by like or corresponding reference numerals.

DETAILED DESCRIPTION OF THE PREFERRED EMBODIMENTS

Figure 1:
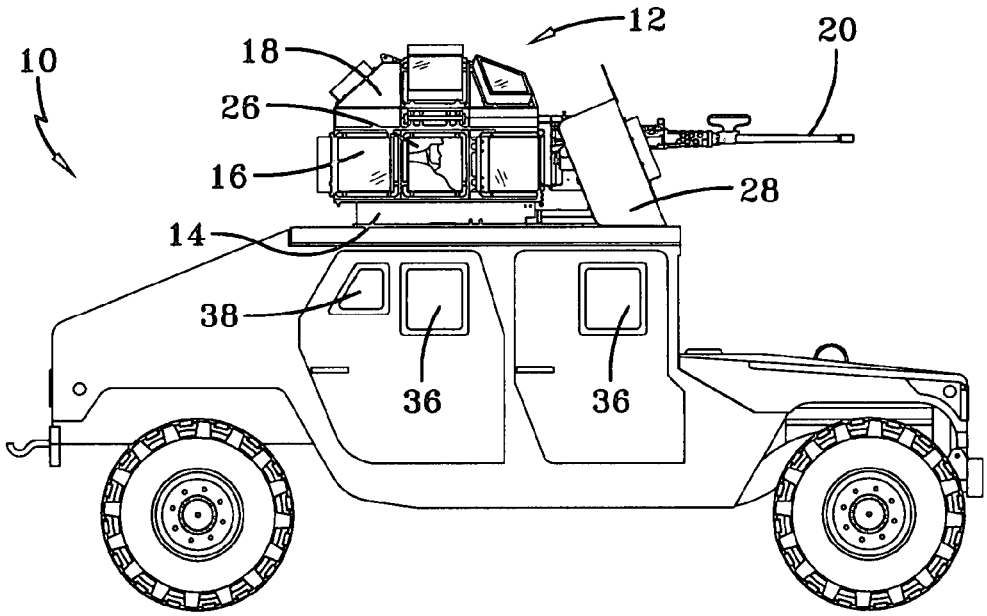
FIG. 1 is a side view of a vehicle with an embodiment of the invention mounted thereon.
Figure 2:
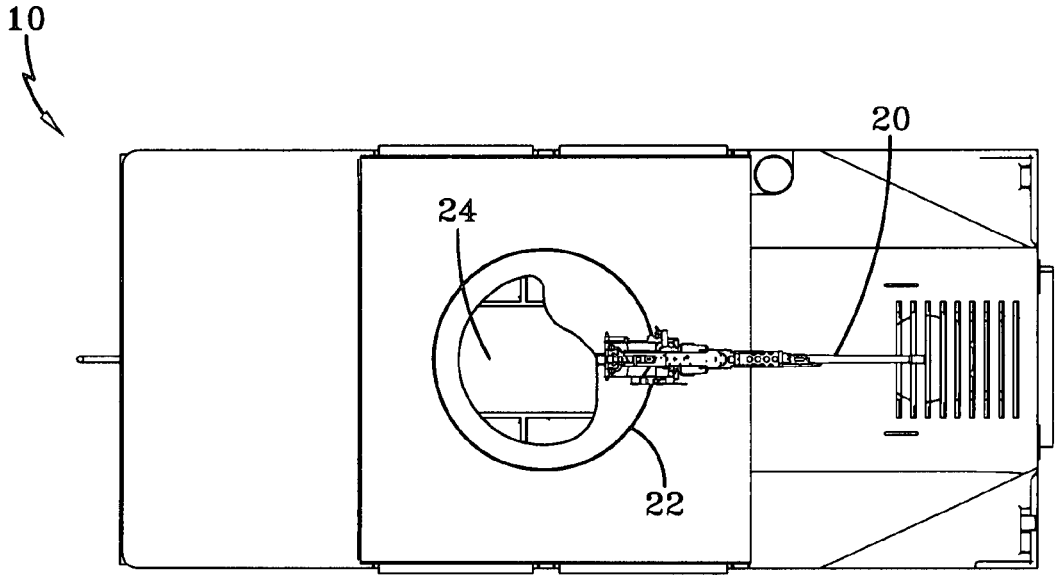
FIG. 2 is a top view of the vehicle of FIG. 1 without the an embodiment of the invention mounted thereon.

FIG. 1 is a side view of a vehicle 10 with one embodiment of a vehicle protective structure 12 mounted thereon. FIG. 2 is a top view of the vehicle 10 of FIG. 1 without the structure 12 mounted thereon. Structure 12 includes a first portion 14, a second portion 16 and a third portion 18. The first portion 14 is fixed to a turret (traversal portion) 22 (FIG. 2) on an upper section of the vehicle 10 and disposed around an opening 24 (FIG. 2). The second portion 16 is fixed to the first portion 14 and includes a plurality of windows disposed substantially vertically around the opening 24.

Windows used in these embodiments of the invention are ballistic windows. Ballistic windows are components that are capable of stopping bullets or projectiles, including bomb or explosive fragments, fired at it and can be made of impact resistant materials including materials known as bullet-resistant glass or ballistic windows. The term "bullet" is meant to be used broadly in this case referring to ballistic or high velocity projectiles or weapons, including fragmentary devices and explosives or explosively formed projectiles, which are fired at or in the direction of the window(s) in question. Bullet-resistant glass is frequently constructed using a strong but transparent material such as polycarbonate thermoplastic or by using layers of laminated glass. One desired result is a material with an appearance and light-transmitting behavior of standard glass but offers varying degrees of protection from projectile weapons depending on the weight, configuration and weight requirements or limitations. A polycarbonate layer, including products such as Cyrolon®, Lexan® and Tuffak®, is sometimes sandwiched between layers of regular glass. The use of plastic in the laminate provides impact-resistance, such as physical assault with a hammer, an axe, etc. The plastic provides little in the way of bullet-resistance. The glass, which is much harder than plastic, flattens the bullet and thereby prevents penetration. Ballistic windows, ballistic glass, impact resistant glass or bullet-resistant glass can be 70-75 mm (2.8-3.0 in) thick, but could be more or less depending on the threat or weapons the windows are designed to defeat. Bullet-resistant glass includes glass constructed of laminated glass layers built from glass sheets bonded together with polyvinyl butyral or polyurethane. The glass can include one-way bullet-resistant glass as well as newer types of bullet-resistant glass or transparent materials such as aluminum oxynitride used as the outside "strike plate" layer.

The third portion 18 is fixed to the second portion 16 and extends upwardly and inwardly from the second portion 16 over the opening 24. The third portion 18 includes a plurality of windows. A shield 28 may be disposed in front of the first, second and third portions 14, 16, 18. In the case of armed conflict, foreign internal defensive operations or riot control engagements, structure 12 can protect a weapons operator or gunner 26 (FIG. 1) who operates a gun 20 or other device such as a water cannon, high intensity laser or other anti-personnel or non-lethal personnel weapon system. The gunner or protective structure occupant 26 is located in the opening 24. However, structure 12 can protect individuals other than a gunner 26, for example, an observer. Structure 12 can also be used to protect or mount a sensor system or other items of equipment requiring protection and impact resistant windows standing alone or in combination with a weapons system or other anti-personnel or riot control system.

Figure 3:
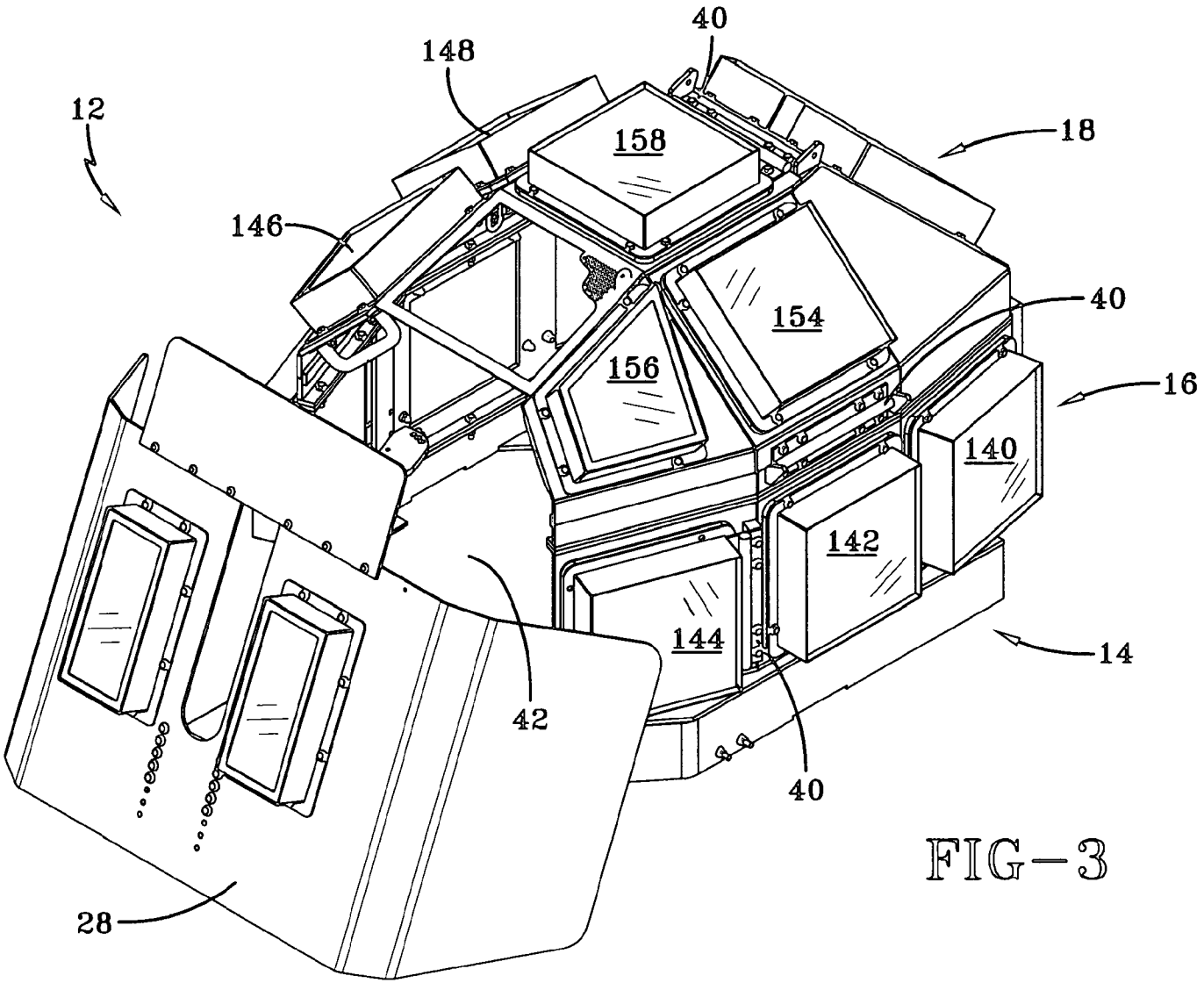
FIG. 3 is a perspective view of one embodiment of a vehicle protective structure.
Figure 4A:
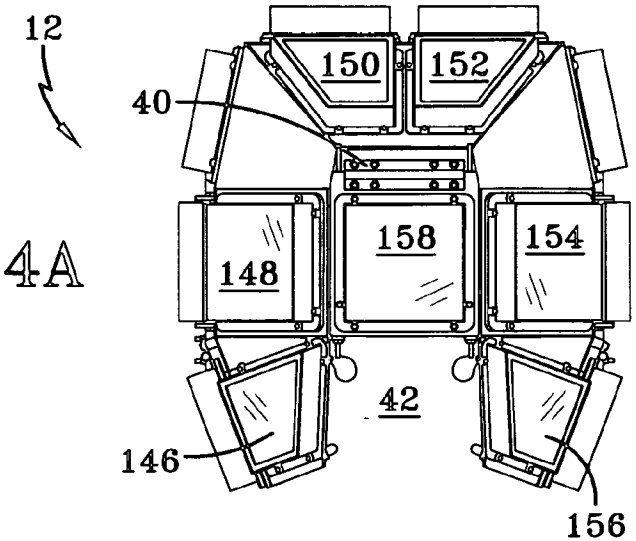
FIGS. 4A, 4B, 4C 4D and 4E are top, front, curb side, driver side and rear views, respectively, of the structure of FIG. 3, without the shield.

FIG. 3 is a perspective view of the vehicle protective structure 12 without the vehicle 10. FIGS. 4A, 4B, 4C 4D and 4E are top, front, curb side, driver side and rear views, respectively, of the structure 12 of FIG. 3, without the shield 28. As best seen in FIGS. 3 and 4A, the first, second and third portions 14, 16, 18 define a front opening 42. The gun 20 (FIG. 1) is disposed in the front opening 42 and the shield 28 (FIG. 3) is mounted adjacent the front opening 42.

In the embodiment shown in FIGS. 4A-4E, second portion 16 includes windows 130, 132, 134, 136, 138, 140, 142, 144. Window 130 is the front curb side window; window 132 is the second curb side window; window 134 is the rear curb side window; window 136 is the right rear window; window 138 is the left rear window; window 140 is the rear driver side window, window 142 is the second driver side window; and window 144 is the front driver side window.

The windows 130, 132, 134, 136, 138, 140, 142, 144 of the second portion 16 are substantially planar (not curved) and may be rectangular in shape. Second portion 16 may have eight windows as shown, but more or fewer windows may be used.

The eight windows 130, 132, 134, 136, 138, 140, 142, 144 may be the same size and, additionally, may be the same type of window (i.e., interchangeable) as the windows 36 in the doors of the vehicle 10 of FIG. 1. "Same type" of window means the windows have substantially the same size and shape and are interchangeable without any modifications. One or more of the windows 130, 132, 134, 136, 138, 140, 142 and 144 may be hinged. In FIGS. 4A-4E, the front driver side and curb side windows 144, 130 are shown mounted with hinges 40 to the second portion 16. Hinges 40 allow windows 144, 130 to rotate outward and rearward.

Third portion 18 may have seven windows 146, 148, 150, 152, 154, 156, 158 as shown, but more or fewer windows may be used. Window 146 is the front curb side window; window 148 is the rear curb side window; window 150 is the right rear window; window 152 is the left rear window; window 154 is the rear driver side window; window 156 is the front driver side window; and window 158 is the top window. Windows 146, 148, 150, 152, 154, 156 and 158 may be substantially planar.

The windows 148, 158, 154 may be the same type of window (i.e., interchangeable) as the windows 130, 132, 134, 136, 138, 140, 142, 144 of the second portion 16 and the windows 36 of the vehicle doors. Windows 148, 158 and 154 may be rectangular. Windows 146, 150, 152, 156 may be trapezoidal in shape and be the same type of window (i.e., interchangeable) as the window 38 in the door of vehicle 10 (FIG. 1). Top window 158 (FIG. 4A) may be mounted with a hinge 40 so that window 158 may rotate upwardly and rearwardly.

Front and rear driver side windows 156, 154 (FIG. 4C) may be mounted to the second portion 16 as a single unit using hinge 40. Thus, front and rear driver side windows 156, 154 may rotate outwardly and downwardly as a single unit. Front and rear curb side windows 146, 148 (FIG. 4D) may be similarly mounted using a hinge 40 to thereby rotate outwardly and downwardly as a single unit. The front driver and curb side windows 156, 146 may be the same type of window as window 38 in the door of vehicle 10 (FIG. 1), that is, substantially trapezoidal. The rear driver and curb side windows 154, 148 may be the same type of window as window 36 in the door of vehicle 10 (FIG. 1), that is, substantially rectangular.

Third portion 18 may include right rear and left rear windows 150, 152. The two rear windows 150, 152 may be the same type of window as window 38 in the door of vehicle 10 (FIG. 1), that is, substantially trapezoidal.

Figure 5A:
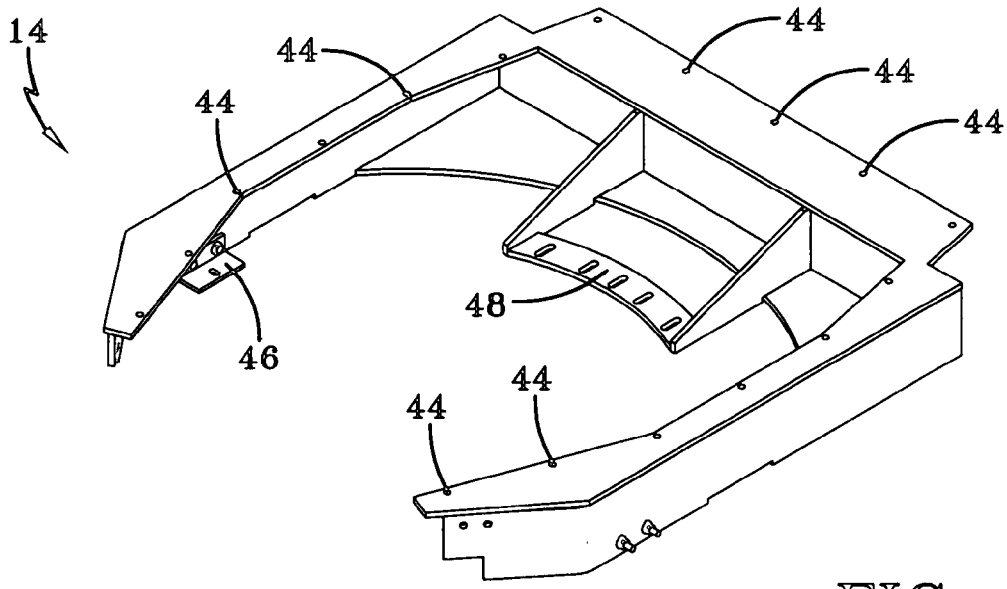
FIGS. 5A and 5B are perspective and top views, respectively, of an embodiment of a first portion of a vehicle protective structure.
Figure 5B:
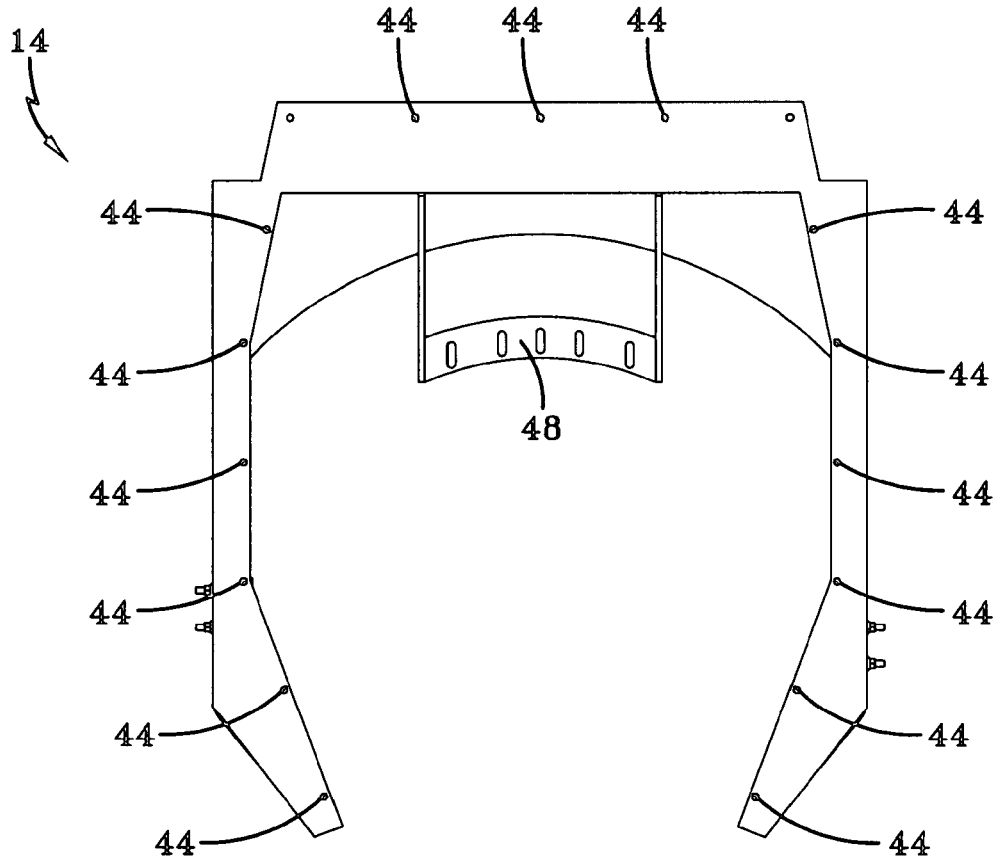

FIGS. 5A and 5B are perspective and top views, respectively, of one embodiment of a first portion 14 of the vehicle protective structure 12. The bolt holes 44 in the first portion 14 form a pattern that may be the same pattern as the bolt hole pattern in both the second portion 16 (FIG. 6B) and the third portion 18 (FIG. 8C). First portion 14 includes a pair of mounting brackets 46 and a rear bolt weldment 48 for fixing the first portion 14 to a vehicle, such as vehicle 10.

Figure 6A:
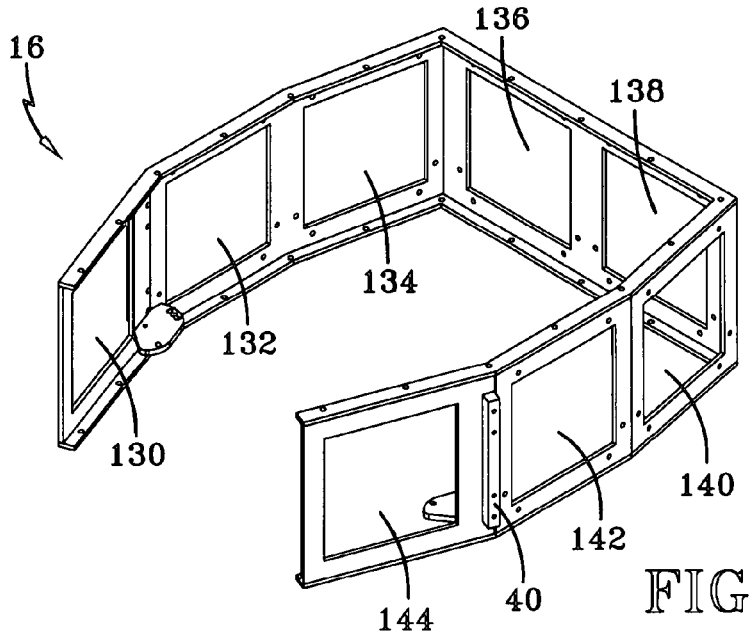
FIGS. 6A, B, C, D, E and F are perspective, top, sectional, curb side, rear and driver side views of an embodiment of a second portion of a vehicle protective structure.

FIGS. 6A, B, C, D, E and F are perspective, top, sectional, curb side, rear and driver side views of an embodiment of a second portion 16 of a vehicle protective structure 12. FIG. 6C is a sectional view along the line 6C-6C of FIG. 6E. The windows 130, 132, 134, 136, 138, 140, 142, 144 of the second portion 16 are not shown in FIGS. 6A-6F. However, the window openings in second portion 16 for windows 130, 132, 134, 136, 138, 140, 142 and 144 are labeled with the corresponding window reference numeral for clarity.

The gun 20 (FIG. 1) fits in front opening 42 (FIGS. 6A, B, C). Front opening 42 provides for about 60 degrees of horizontal gun rotation, that is, about 30 degrees each side of the center position. Thus, the first, second and third portions 14, 16, 18 provide about 300 degrees of protective to the gunner. The pattern of the bolt holes 50 (FIG. 6B) may be the same as the pattern of the bolt holes 44 in the first portion 14 (FIG. 5A) and the pattern of the bolt holes 52 in the third portion 18 (FIG. 8C).

Figure 6B:
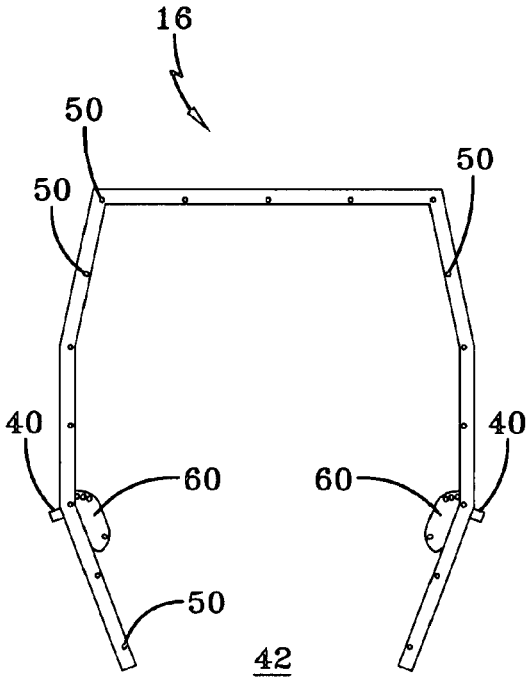
FIG. 6C is a sectional view along the line 6C-6C of FIG. 6E.
Figure 7A:
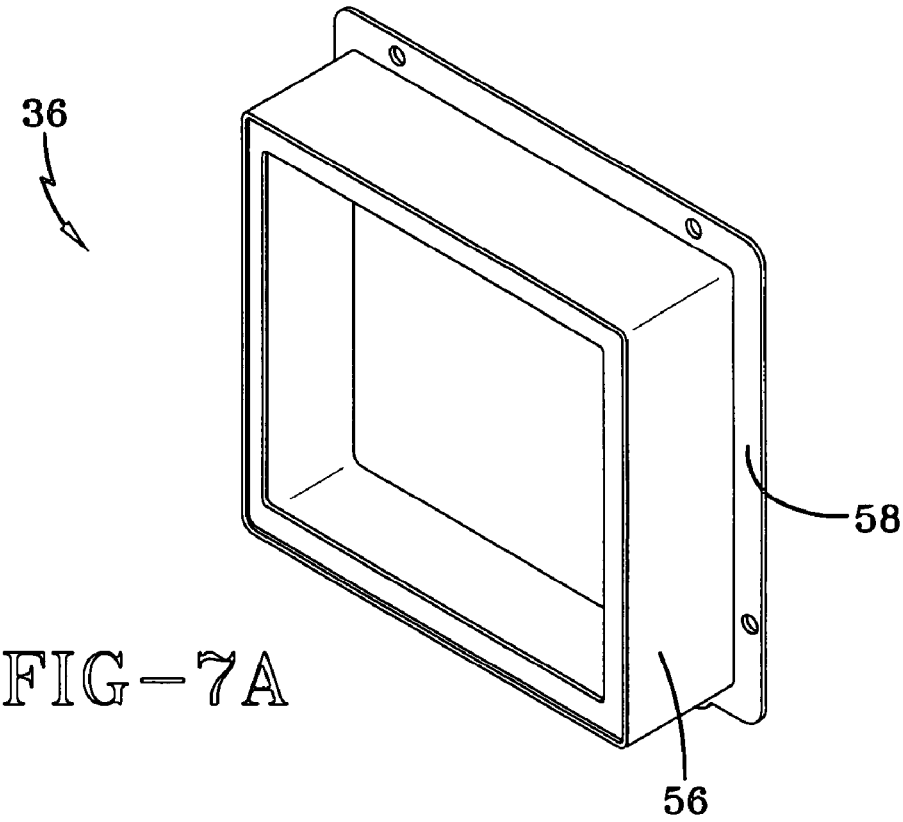
FIGS. 7A and 7B are perspective views of one type of ballistic windows.

FIG. 7A shows a rectangular ballistic window 36 (see also FIG. 1) that includes a frame 56 and a flange 58. Windows 36 may be used for windows 130, 132, 134, 136, 138, 140, 142, 144 of the second portion 16. Flange 58 may be bolted to second portion 16 so that each window is positioned in a corresponding window opening. The front driver side and front curb side windows 144, 130 (see also FIGS. 4D and 4C), rather than being bolted to the second portion 16, may be mounted on a hinge 40. A manually operated opening and closing device 60 (FIG. 6B) (details not shown) may be provided for rotating the front driver side and front curb side windows 144, 130 outwardly.

Figure 7B:
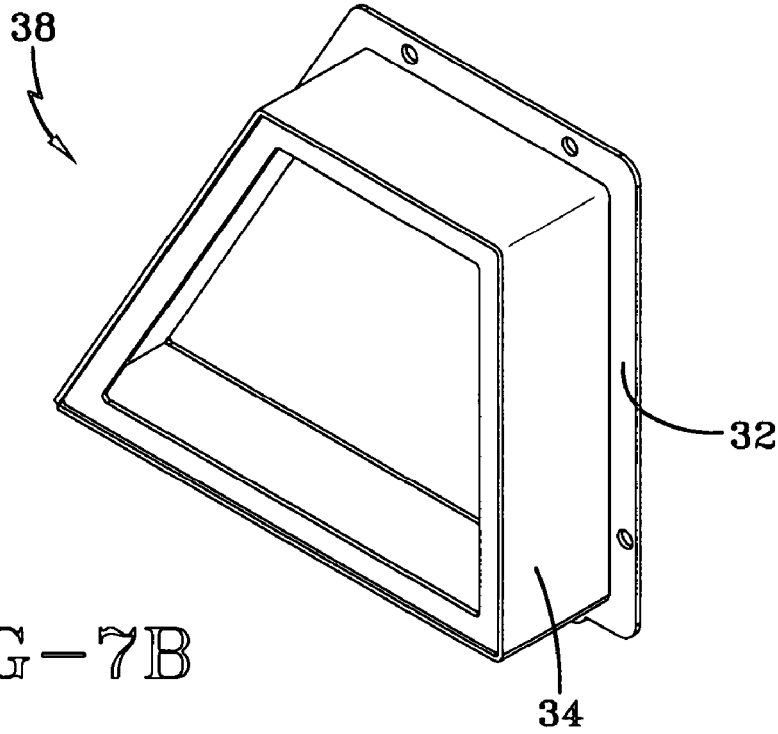
Figure 8A:
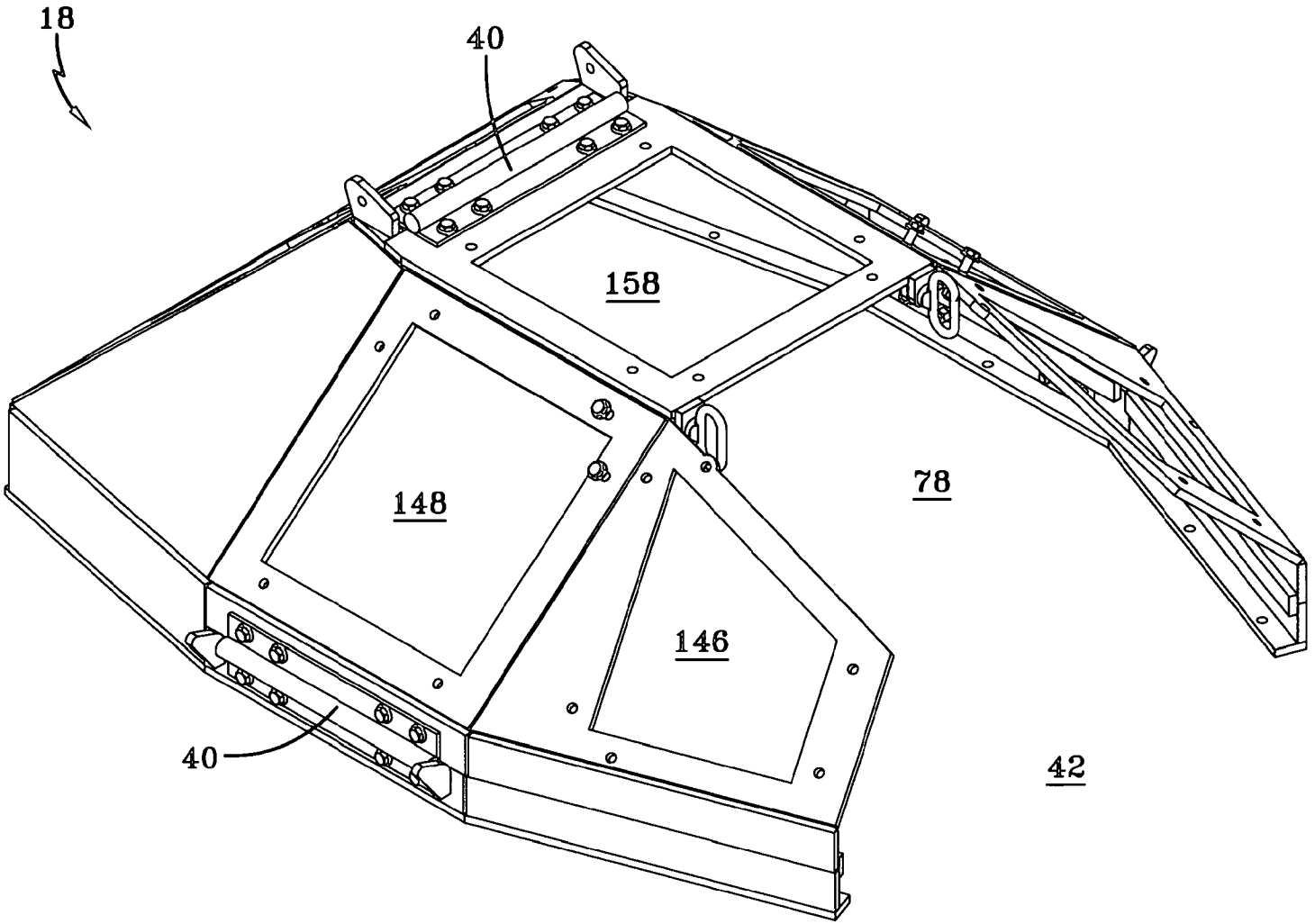
FIGS. 8A, B, C, D, E, F, and G are perspective, top, bottom, curb side, front, driver side, and rear views, respectively, of an embodiment of an third portion of a vehicle protective structure.
Figure 8C:
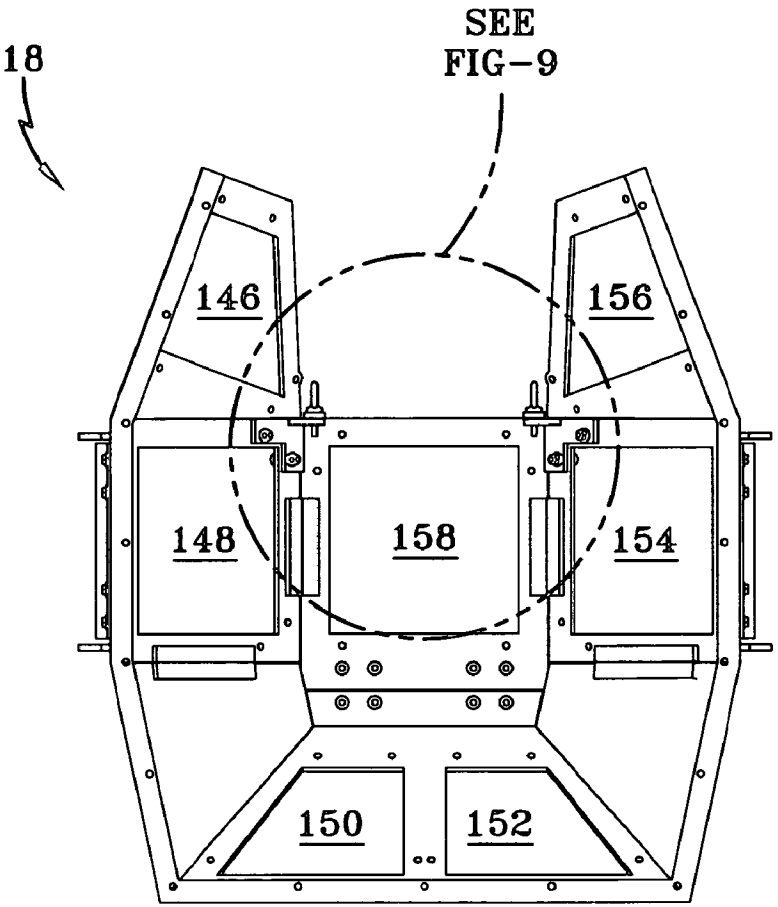

FIGS. 8A, B, C, D, E, F, and G are perspective, top, bottom, curb side, front, driver side, and rear views, respectively, of an embodiment of an third portion 18 of a vehicle protective structure 12. The windows 146, 148, 150, 152, 154, 156, 158 of the third portion 18 are not shown in FIGS. 8A-8G. However, the window openings in third portion 18 for windows 146, 148, 150, 152, 154, 156, 158 are labeled with the corresponding window reference numeral for clarity. Ballistic window 36 of FIG. 7A may be used for windows 148, 158, 154. FIG. 7B shows a ballistic window 38 (see also FIG. 1) having a frame 34 and a flange 32. Ballistic window 38 may be used for windows 150, 152, 156. Flange 32 may be bolted to third portion 18 so that each window is positioned in a corresponding window opening.

Figure 8B:
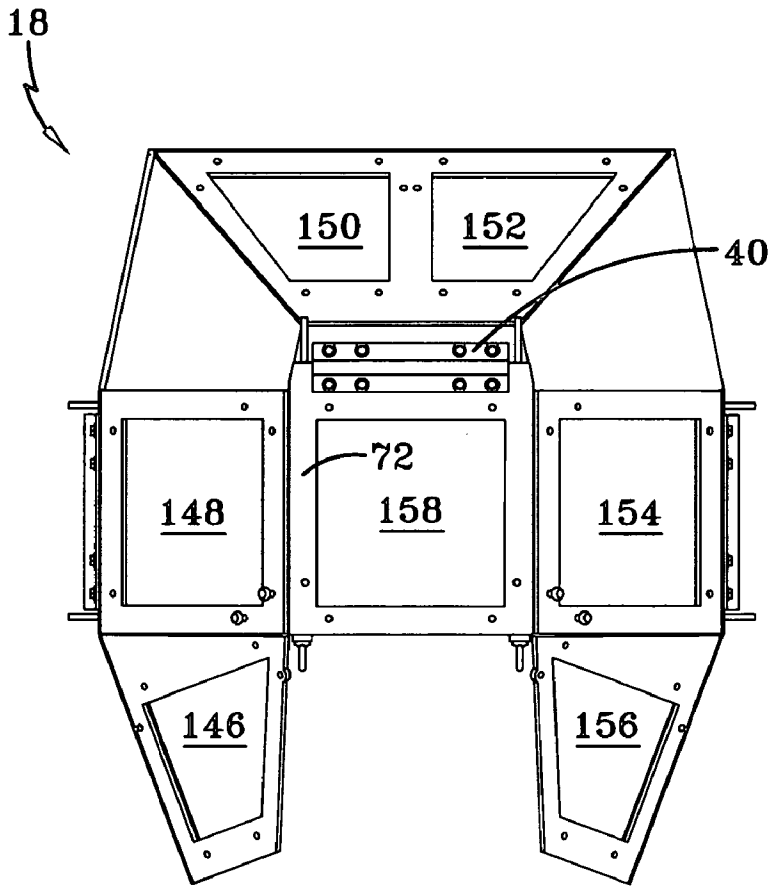
Figure 8E:
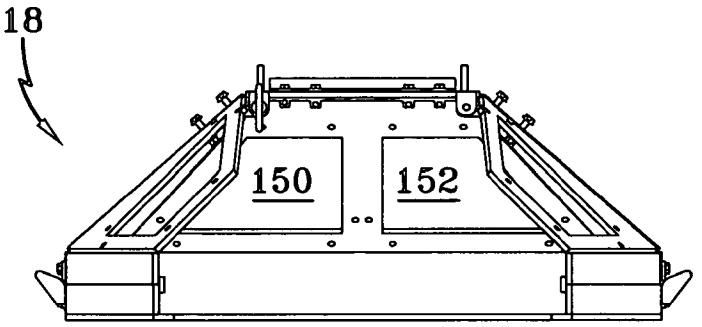
Figure 8G:
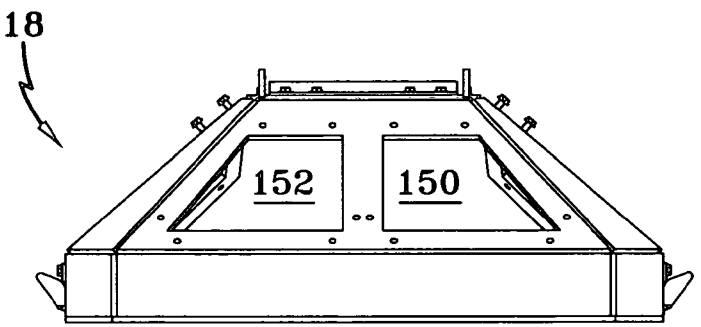
Figure 8D:
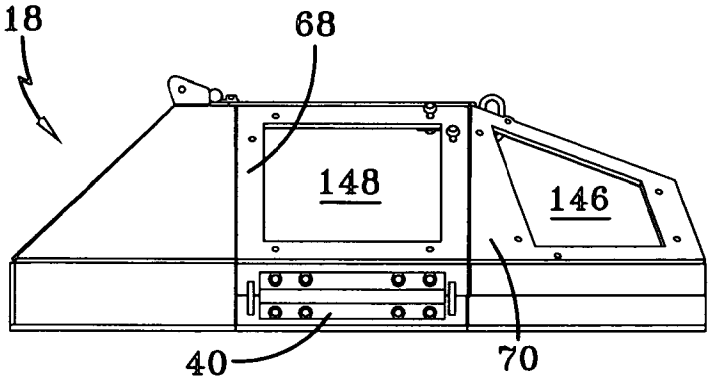
Figure 8F:
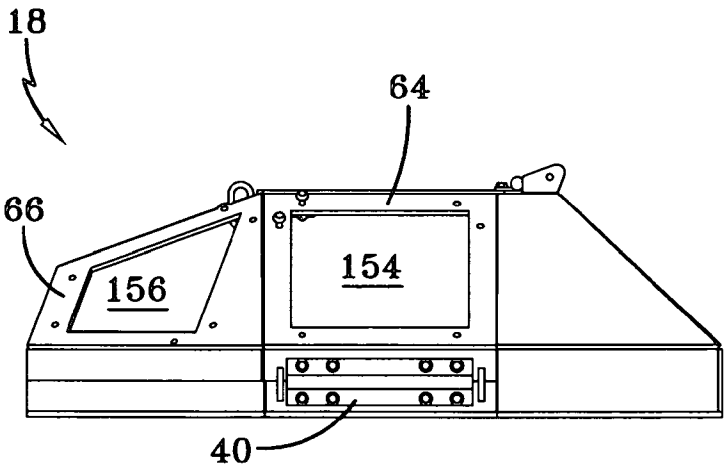

Referring to FIGS. 8F and 8D, the front and rear driver side windows 156, 154 and the front and rear curb side windows 146, 148 are fixed to respective frames 66, 64, 70, 68. Frame 64 is fixed to a hinge 40 and frame 66 is fixed to frame 64 such that windows 156, 154 may be rotated outwardly and downwardly as a single unit. Similarly, frame 68 is fixed to a hinge 40 and frame 70 is fixed to frame 68 such that windows 146, 148 may be rotated outwardly and downwardly.

Figure 9:
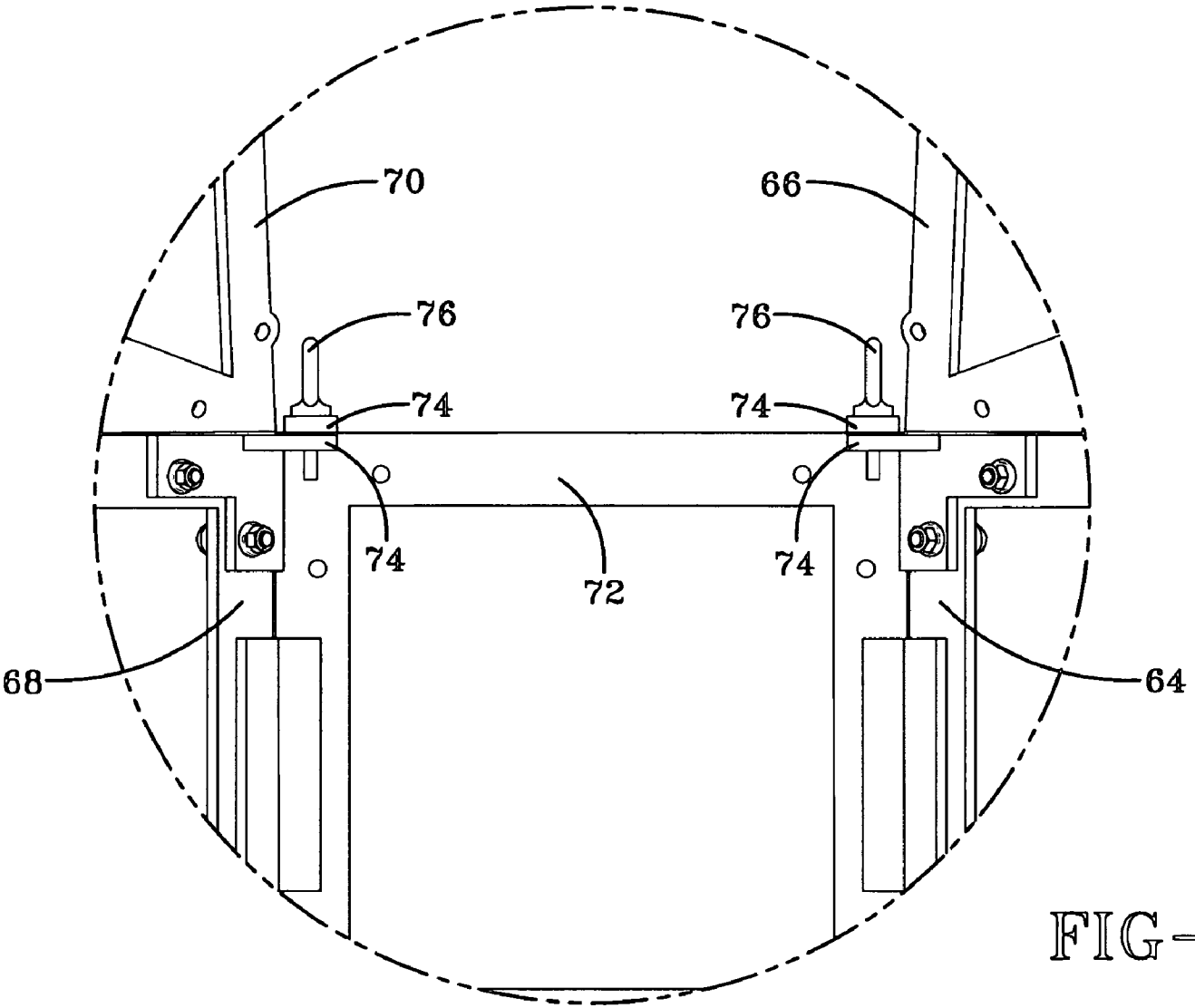
FIG. 9 is an enlarged view of a portion of FIG. 8C.

Referring to FIG. 8B, frame 72 for window 158 may be fixed to third portion 18 with a hinge 40 such that window 158 may be rotated upwardly and rearwardly. To secure top window 158, driver side windows 156, 154 and curb side windows 146, 148 in a closed position, flanges or bosses 74 (FIG. 9) are fixed to frames 72, 68 and 64. Frame 72 has two bosses 74 and frames 68, 64 have one boss each. Each boss 74 includes an opening therein for receiving a quick release pin 76. Thus, the opening in boss 74 of frame 68 is aligned with the opening in one of the bosses 74 of frame 72 and pin 76 is inserted therein. Similarly, the opening in boss 74 of frame 64 is aligned with the opening in the other of the bosses 74 of frame 72 and pin 76 is inserted therein. To rotate the top window 158 and the side windows 156, 154 and 146, 148, the quick release pins 76 are removed from the openings in the bosses 74. Pins 76 may be attached to lanyards to prevent misplacing them.

Figure 10B:
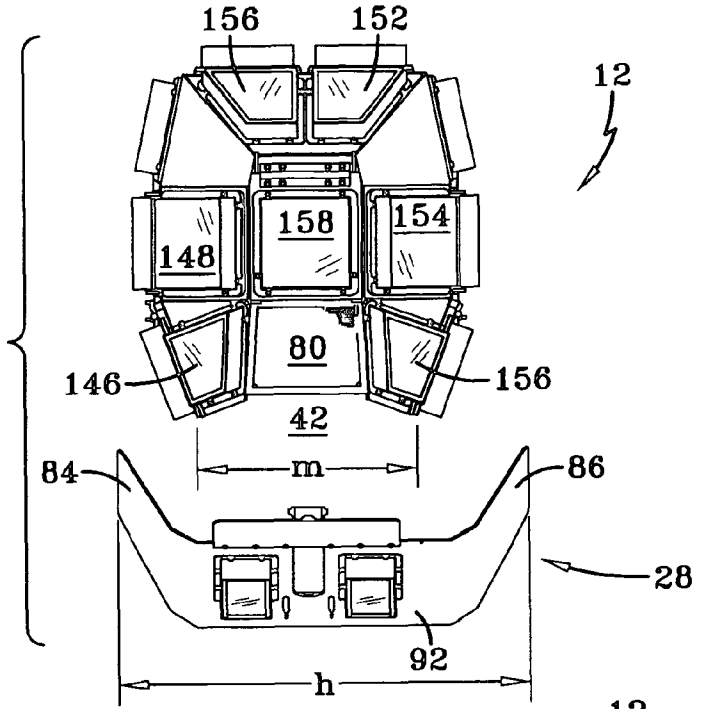
FIGS. 10A, 10B, and 10C are front, top and curb side views, respectively, of FIG. 3.

Referring to FIG. 8A, upper opening 78 in third portion 18 may be closed with an elastic net 80 shown in FIG. 10B.

Figure 6C:
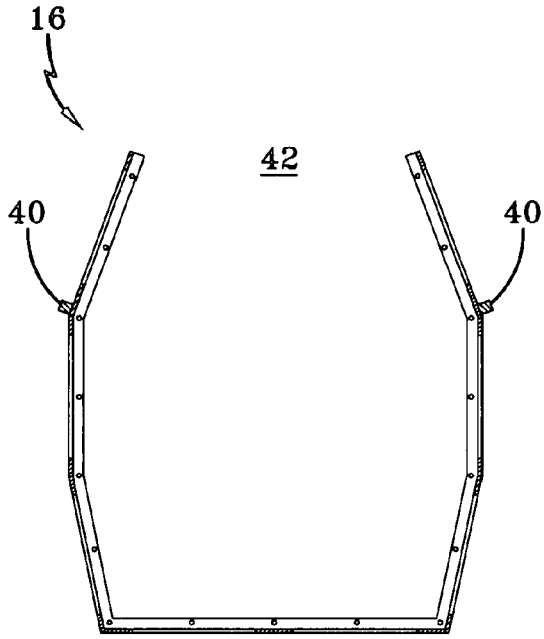
Figure 6D:
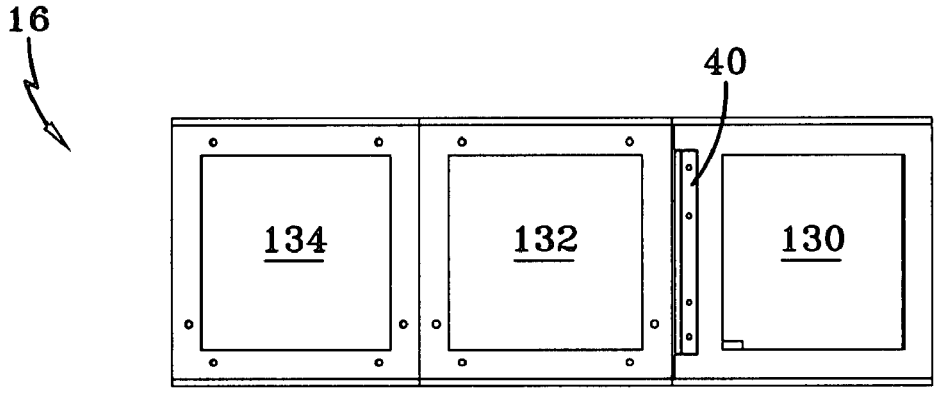
Figure 6E:
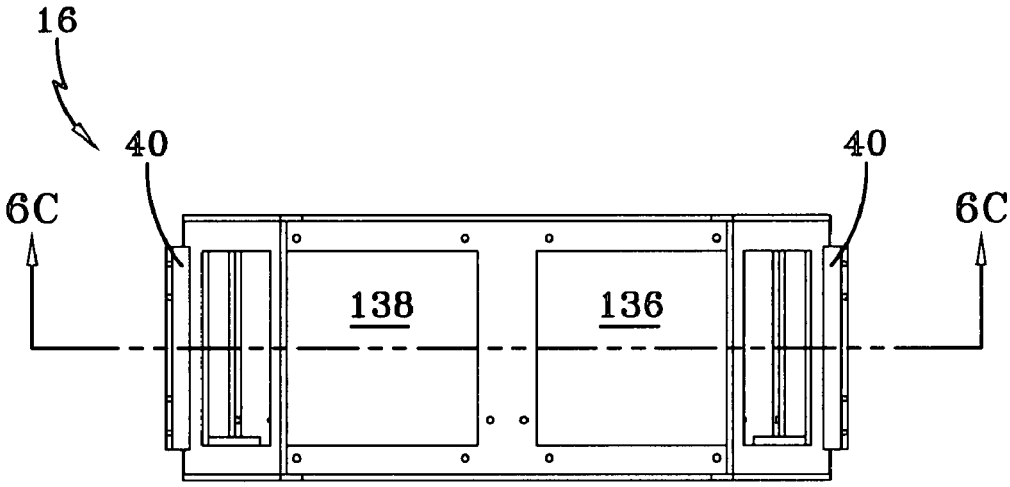
Figure 6F:
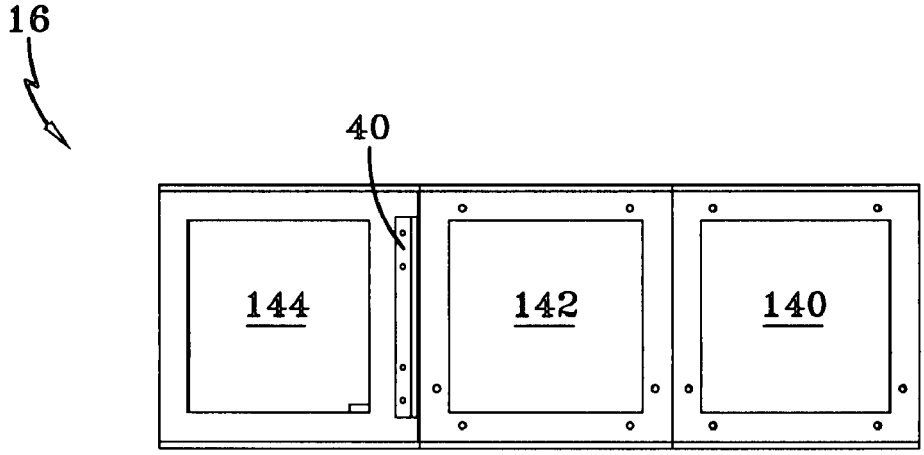

Referring to FIG. 8C, the pattern of the bolt holes 52 (FIG. 8C) may be the same as the pattern of the bolt holes 44 in the first portion 14 (FIG. 5A) and the pattern of the bolt holes 50 in the second portion 16 (FIG. 6B). In one embodiment, the second portion 16 is fixed to the first portion 14 using threaded fasteners all having the same size head and the third portion 18 is fixed to the second portion 16 using threaded fasteners all having the same size head as the fasteners used to fix the second portion 16 to the first portion 14. In some embodiments of the invention, the second portion 16 is not used and the third portion 18 is fixed directly to the first portion 14. In other embodiments of the invention, the second portion 16 is fixed to the first portion 14 and the third portion 18 is not included.

Figure 4B:
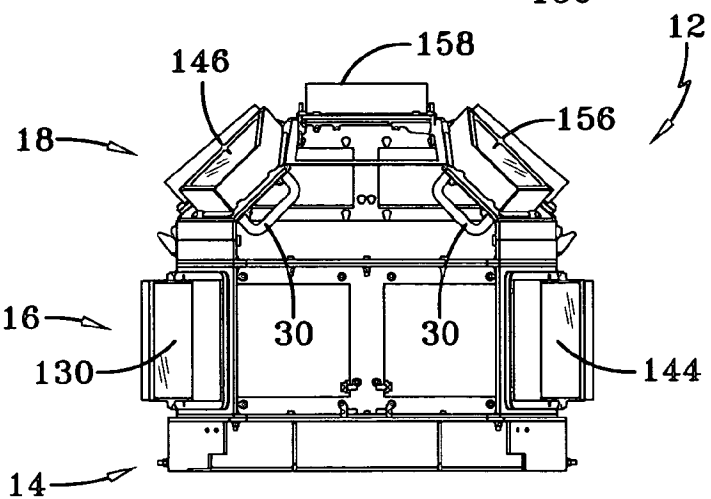
Figure 4C:
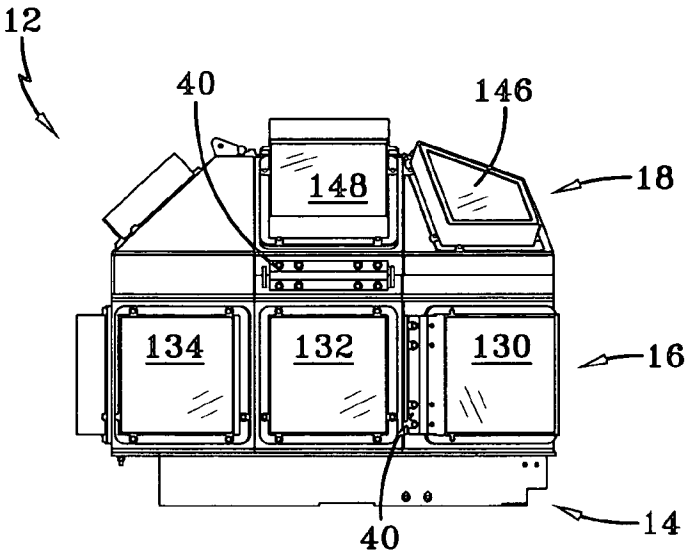
Figure 4E:
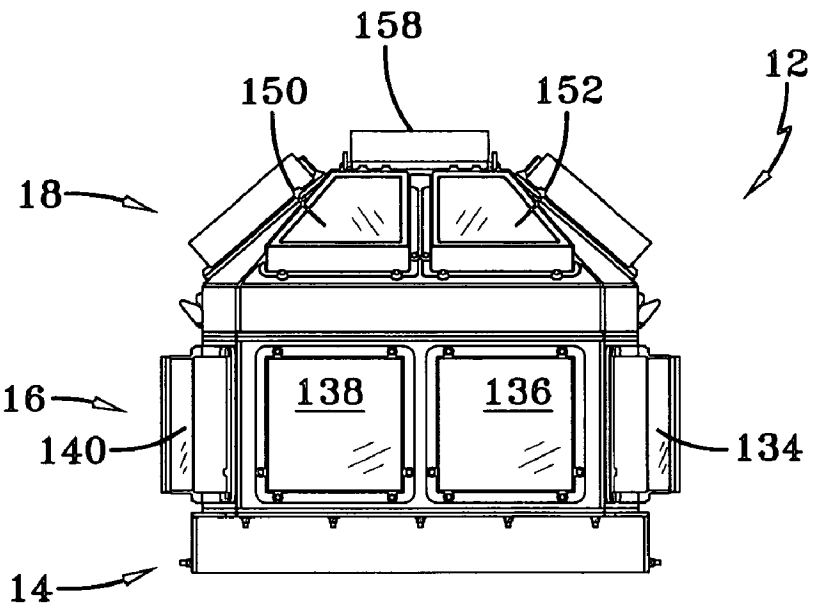
Figure 4D:
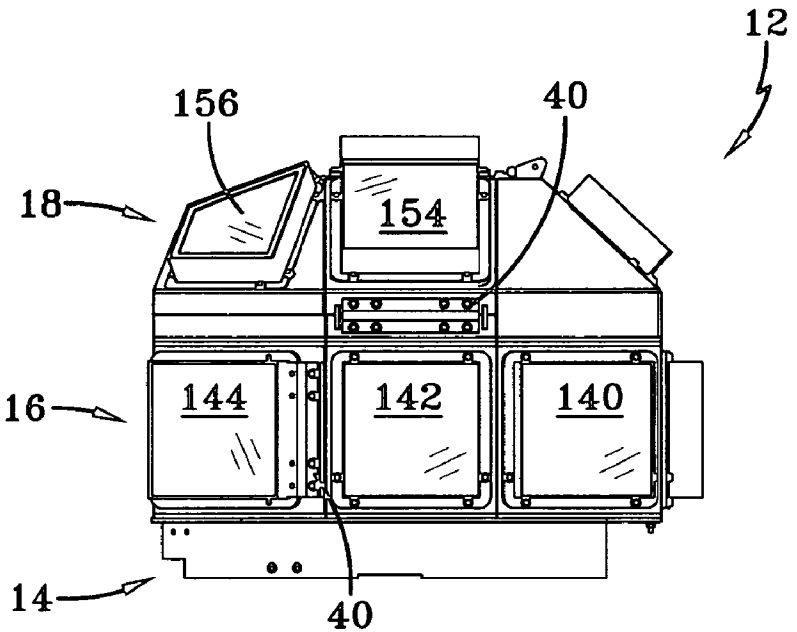

Third portion 18 may include one or more handles 30 (FIGS. 4A and 4B).

Figure 10A:
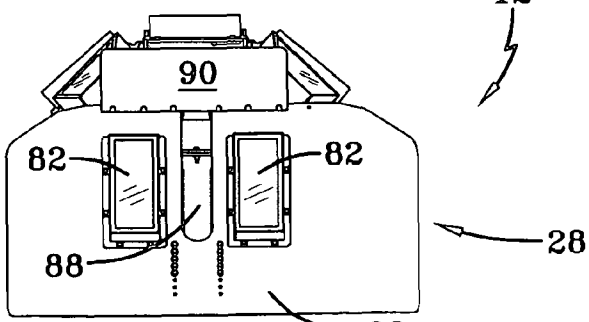
Figure 10C:
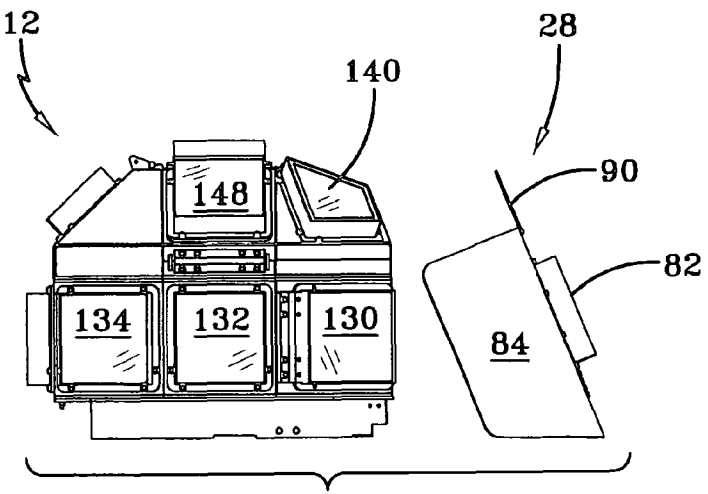

FIGS. 10A, 10B, and 10C are front, top and curb side views, respectively, of FIG. 3. Shield 28 may be fixed to a pintle (not shown) that is used to mount the gun 20 (FIG. 1). Shield 28 includes a front portion 92 and right and left side portions 84, 86 that extend rearwardly from the front portion 92. Front portion 92 includes at least one ballistic window 82 and an opening 88 for gun 20 (FIG. 1). The transverse extent "h" (FIG. 10B) of the shield 28 is greater than the transverse extent "m" of the front opening 42. Front portion 92 may include a top plate 90 that extends above the opening 88.

Projectile resistant armor (e.g., steel) and ballistic glass may be used to fabricate vehicle protective structure 12.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A vehicle, comprising:

an opening and a turret around the opening; and a vehicle protective structure mounted to the vehicle, the vehicle protective structure including a first portion fixed to the turret and disposed around the opening; a second portion fixed to the first portion, the second portion including a plurality of ballistic windows disposed substantially vertically around the opening; and an third portion fixed to the second portion, the third portion extending upwardly and inwardly from the second portion over the opening, the third portion comprising a plurality of projectile resistant members each adapted to selectively pivot along one end of said members and couple to said second portion, said projectile resistant members further adapted to selectively couple to each other of said plurality of members on a second side of said members, said third portion further comprising one or more ballistic windows disposed on each of said plurality of projectile resistant members.

2. The vehicle of claim 1 further comprising at least one door having first and second types of windows therein wherein the plurality of ballistic windows in the second portion comprise windows of the first type and the plurality of ballistic windows in the third portion comprise windows of the first and second types.

* * * * *